US005945647A

United States Patent [19]

Hoskins

[11] Patent Number: 5,945,647

[45] Date of Patent: Aug. 31, 1999

[54] ELECTRICAL CONTROL APPARATUS WITH A MEMBER HAVING ROTARY AND AXIAL OPERATION

[75] Inventor: Steven R. Hoskins, Walled Lake, Mich.

[73] Assignee: TRW Inc., Lyndhurst, Ohio

[21] Appl. No.: 08/946,336

[22] Filed: Oct. 7, 1997

[51] Int. Cl.[6] ..... H01H 9/00; H01H 21/00

[52] U.S. Cl. ..... 200/18; 200/4

[58] Field of Search ..... 200/1 R, 4, 5 R, 200/6 R, 14, 11 R, 11 D, 11 DA, 16 R, 16 A, 16 C, 16 D, 17 R, 18, 520, 529, 533, 536, 564, 566, 570, 571, 329, 336, 341

[56] References Cited

U.S. PATENT DOCUMENTS

| | | | |
|---|---|---|---|
| 2,669,611 | 2/1954 | Silvius | 200/4 |
| 3,229,052 | 1/1966 | Silvius et al. | 200/11 |
| 5,012,056 | 4/1991 | Abel et al. | 200/519 |

*Primary Examiner*—Michael A. Friedhofer
*Attorney, Agent, or Firm*—Tarolli, Sundheim, Covell Tummino & Szabo

[57] ABSTRACT

An apparatus (10) controls electrical energy for energizing power utilization devices (14, 16). A control member (28) has a knob (30) for manual engagement and a stem (34) extending along an axis (32). The stem (34) extends into a housing (46) which houses a rotary assembly (84) and a slider member (128). The rotary assembly (84) has a detent plunger (112) biased to engage notches (40, 42) on the stem (34) and which holds the control member (28) in first and second positions along the axis (32). The stem (34) has a tip (36) engaged by the slider member (128) and the slider member moves linearly, orthogonal to the axis (32) during movement of the control member (28) along the axis. An electrical circuit that includes a power source (12) and one power utilization device (14) is completed during movement of the control member (28) along the axis (32) from an initial position. The stem (34) and the rotary assembly (84) have portions (38, 98) which fix the rotary assembly to rotate about the axis (32) with the control member (28). An electrical circuit that includes the power source (12) and another power utilization device (16) is completed during rotation of the control member (28) and the rotary assembly (84) from the initial position.

20 Claims, 4 Drawing Sheets

ELECTRICAL CONTROL APPARATUS WITH A MEMBER HAVING ROTARY AND AXIAL OPERATION

BACKGROUND OF THE INVENTION

The present invention relates to an apparatus for controlling electrical energy. Specifically, the apparatus has a manually operated control member which is rotatable about an axis and movable along the axis.

A known apparatus has a manually operated control member which is rotatable about an axis and movable along the axis. Electrical contact elements are fixed to move with the control member for rotational and axial movements. Specifically, all of the contact elements rotate during rotation of the control member and all of the contact elements move axially during axial movement of the control member.

SUMMARY OF THE INVENTION

The present invention is an apparatus for controlling electrical energy. A manually operated control member of the apparatus has a knob portion for manual engagement and a stem portion which extends along an axis. The stem portion extends from the knob portion to a tip segment. A panel means of the apparatus has an opening for receiving the stem portion. The control member is manually rotatable about the axis relative to the panel means and is manually movable along the axis relative to the panel means.

The apparatus includes means for electrically connecting a first circuit in response to rotation of the control member. The means for connecting the first circuit includes a rotor member which extends about the stem portion and which is rotatable about the axis relative to the panel means. The control member is movable relative to the rotor member along the axis. Means connect the rotor member and the stem portion to rotate the rotor member during rotation of the control member.

The apparatus includes means for electrically connecting a second circuit in response to movement of the control member along the axis. The axial movement of the control member is relative to the rotor member and the panel means, and the axial movement of the control member is from a first position to a second position. Means bias the control member into the first and second positions, and the bias means includes detent means located between the rotor member and the stem portion.

The means for electrically connecting the second circuit includes a slider member which is constrained to move in a direction transverse to the axis and which moves in the transverse direction during the axial movement of the control member. Specifically, the direction of movement of the slider member is orthogonal to the axis. The slider member has a surface which engages the tip segment of the stem portion. The surface of the slider member slides against the stem portion as the slider member moves during the axial movement of the control member.

BRIEF DESCRIPTION OF THE DRAWINGS

Further features of the present invention will become apparent to those skilled in the art to which the present invention relates from reading the following description with reference to the accompanying drawings, in which.

DESCRIPTION OF A PREFERRED EMBODIMENT

Figure 1:
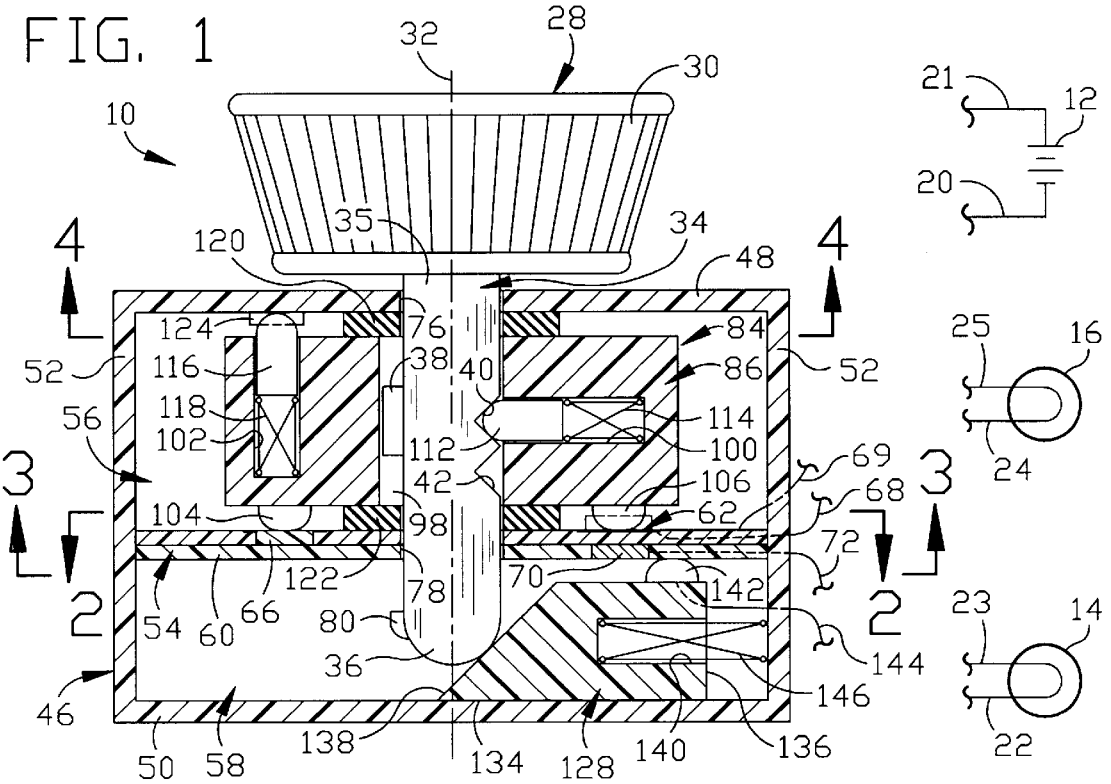
FIG. 1 is a view, partially in section, of an apparatus according to the present invention.

One representation of the present invention, shown in FIG. 1, is an apparatus 10 for controlling electrical energy. Specifically, the apparatus 10 controls the flow of electrical energy from a power source 12 to first and second power utilization devices 14 and 16.

The power source 12 may be any suitable source of electrical energy, such as a battery of a vehicle (not shown). Electrical leads 20, 21 are connected to the power source 12 and electrical energy can flow from the power source through the leads. The first and second power utilization devices 14 and 16 may be any type of power utilization devices, and are preferably illumination lamps of the vehicle. Hereinafter, the first and second power utilization devices 14 and 16 are referred to as first and second lamps, respectively. The first lamp 14 is preferably a vehicle headlight and the second lamp 16 is preferably an interior light in a vehicle occupant compartment of the vehicle. Electrical leads 22, 23 extend from the first lamp 14 and electrical leads 24, 25 extend from the second lamp 16.

The apparatus 10 includes a control member 28 made of plastic. A knob portion or knob 30 of the control member 28 may have any suitable shape such that the knob can be manually grasped by an operator (not shown) of the apparatus 10. In the embodiment shown in the Figures, the knob 30 is symmetrical about an axis 32 and has a radially outer surface which is generally in the shape of a truncated cone.

A stem portion or stem 34 of the control member 28 extends from the knob 30 along the axis 32. The stem 34 has a cylindrical outer major side surface 35. A tip 36 of the stem 34 is located away from the knob 30 and is hemispherical in configuration.

A key projection 38 extends radially outward from the major surface 35 of the stem 34. In the embodiment shown in the Figures, the key projection 38 has an elongate box shape which is elongate in a direction parallel to the axis 32. The extent of the key projection 38 along the axis 32 is equal to a fraction of the overall axial length of the stem 34. The upper end of the key projection 38 is spaced apart from the knob 30 and the lower end of the key projection is spaced apart from the tip 36. Thus, the key projection 38 is located approximately midway between the knob and the tip 36.

First and second notches 40 and 42 extend into the stem 34 of the control member 28 from its major surface 35. The notches 40, 42 are located next to each other, with the first notch 40 being located axially closer to the knob 30 and the second notch 42 being located axially closer to the tip 36. In the embodiment shown in the Figures, the notches 40, 42 have a "V" shape, and each notch extends into the stem 34 a distance which is approximately one-half of the radial distance between the axis 32 and the major surface 35 of the stem. The notches 40, 42 are diametrically opposed to the key projection 38.

Figure 2:
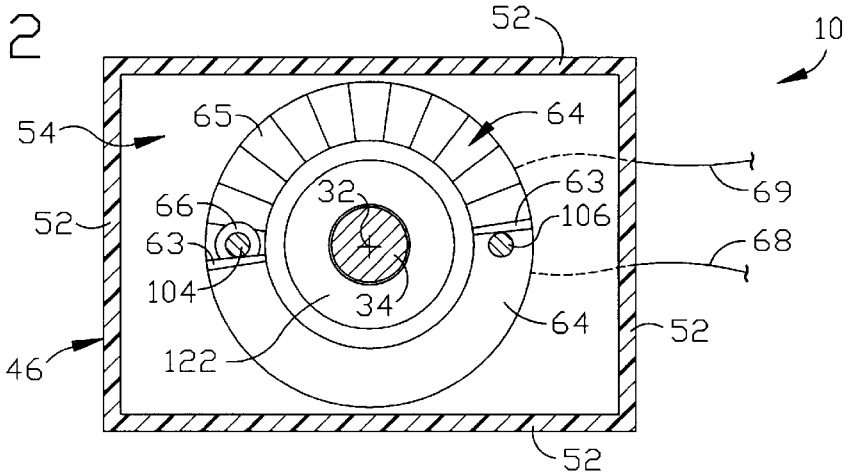
FIG. 2 is a view taken along line 2—2 in FIG. 1.

The apparatus 10 includes a panel housing 46 made of plastic. The housing 46 may be part of a larger structure such as an instrument panel (not shown) of the vehicle. A first wall 48 of the housing 46 is planar and perpendicular to the axis 32. The first wall 48 is the closest portion (the uppermost portion as shown in the Figures) of the housing to the operator of the apparatus 10. A second wall 50 of the housing 46 is planar, parallel to the first wall 48, and spaced from the first wall, i.e., away from the operator. Four side walls 52 (FIG. 2) extend between the first and second walls 48 and 50 (FIG. 1).

An electrical contact wall 54 is located within the housing 46. The contact wall 54 is planar and parallel to the first and second walls 48 and 50. The contact wall 54 is axially spaced from both of the walls 48 and 50 and is secured to the side walls 52 by suitable means (not shown), such as adhesive or fastening elements. A first chamber 56 within the housing 46 is located between the first wall 48 and the contact wall 54, and a second chamber 58 is located between the contact wall and the second wall 50.

The contact wall 54 has two electrical conductor and electrical insulator arrays. One array faces the first chamber 56, upward as viewed in FIG. 1, and the other array faces the second chamber 58, downward as viewed in FIG. 1. In the preferred embodiment, the contact wall 54 is insert molded such that electrical contact areas of each array are supported on an electrically insulating substrate layer 60 made of plastic.

The upward facing array includes a ring-shaped electrical contact terminal grid 62 (FIG. 2) located on the upper surface of the contact wall 54. The terminal grid 62 is divided into two halves by stops 63. The stops 63 are raised portions of the layer 60 (FIG. 1). One half of the terminal grid 62 (FIG. 2) is a conductor 64 made of metal, such as copper.

The other half of the terminal grid 62 includes a resistor 65 (schematically shown) made of electrically resistive material which provides a variable resistance dependent upon the amount of the material that a current must pass though in a completed circuit. An electrical insulator segment 66 is located in the resistor 65 adjacent to one of the stops 63. An electrical lead 68 extends from the conductor 64 and an electrical lead 69 extends from the resistor 65. The leads 68, 69 extend out from the housing 46.

Figure 3:
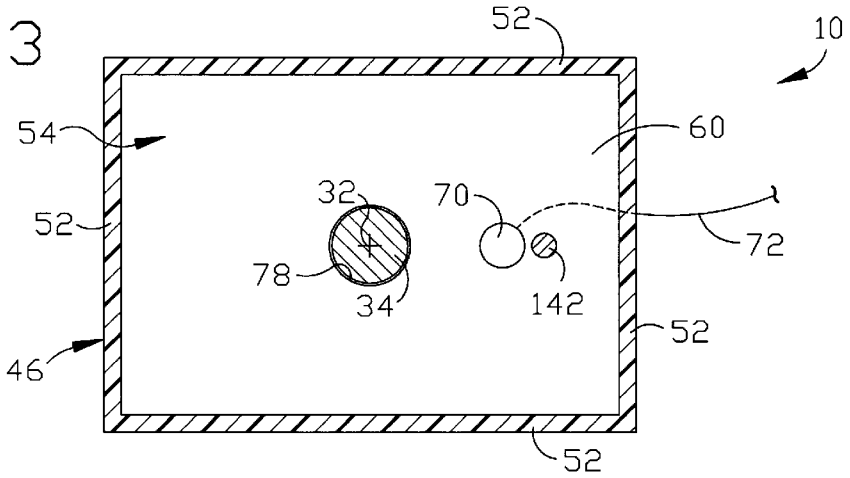
FIG. 3 is a view taken along line 3—3 in FIG. 1.

The downward facing array on the contact wall 54 (FIG. 1) has an single electrical conductor 70 (FIG. 3) surrounded by the electrically insulating material of the layer 60. In the preferred embodiment, the conductor 70 is made of copper. An electrical lead 72 extends from the conductor 70 and out from the housing 46.

An opening 76 (FIG. 1) extends through the first wall 48 and an opening 78 extends through the contact wall 54. The openings 76 and 78 are centered on the axis 32. The stem 34 of the control member 28 extends through the opening 76, across the first chamber 56, through the opening 78, and partially across the second chamber 58. The tip 36 of the stem 34 is located a distance away from the second wall 50. The knob 30 of the control member 28 is located outside of the housing 46, adjacent to the first wall 48 and accessible to the operator.

The control member 28 is movable relative to the housing 46 in linear directions along the axis 32 and is rotatable relative to the housing about the axis. A suitable means is provided to prevent complete withdrawal of the stem 34 of the control member 28 from the housing 46. In the preferred embodiment, the means for preventing withdrawal includes a retainer projection 80 extending radially outward from the major surface 35 of the stem 34 at a location adjacent to the tip 36. The retainer projection 80 is tapered such that the control member 28 may be pushed into the housing 46 along the axis 32 (downward as viewed in FIG. 1) during initial assembly of the apparatus 10. The retainer projection 80 has a flat or blunt end which can abut the contact wall 54 and prevent movement (upward as viewed in FIG. 1) of the retainer projection past the contact wall 54.

Figure 5:
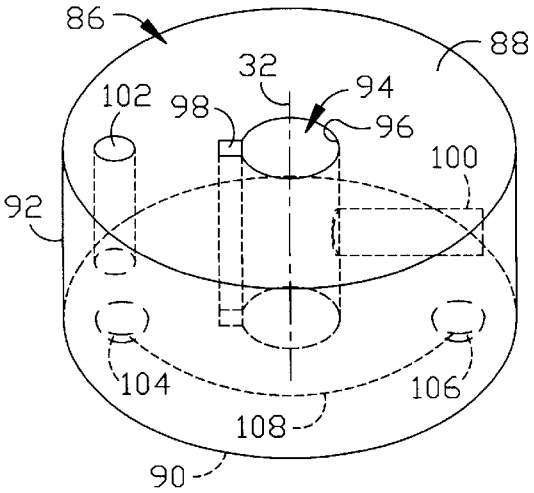
FIG. 5 is an illustration of a part of the apparatus of FIG. 1.

A rotary assembly 84 of the apparatus 10 includes a plastic rotor member 86. The rotor member 86 (FIG. 5) has planar, radially extending, upper and lower end surfaces 88 and 90 which are parallel to each other and perpendicular to the axis 32. A cylindrical outer side surface 92 of the rotor member 86 extends parallel to the axis 32 between the end surfaces 88 and 90 and defines the radially outer periphery of the rotor member 86.

A central opening 94 extends along the axis 32 through the rotor member 86 between the end surfaces 88 and 90. The central opening 94 has a cylindrical portion 96 centered on the axis 32 and a key receiving portion 98 extending radially from the cylindrical portion. The cross-sectional shape of the key receiving portion 98, taken perpendicular to the axis 32, is the same as the cross-sectional shape of the key projection 38 (FIG. 1) of the control member 28, also taken perpendicular to the axis. The cylindrical portion 96 of the central opening 94 is slightly larger in diameter than the stem 34 of the control member 28.

A detent recess 100 (FIG. 5) in the rotor member 86 extends radially outward from the cylindrical portion 96 of the central opening 94, in a direction perpendicular to the axis 32. The detent recess 100 does not extend to the cylindrical surface 92 and terminates within the rotor member 86. The detent recess 100 is diametrically opposite the key receiving portion 98.

Another detent recess 102 in the rotor member 86 extends from the upper end surface 88 of the rotor member and into the rotor member, in a direction parallel to the axis 32. The detent recess 102 does not extend completely through the rotor member 86 and terminates within the rotor member. In the embodiment shown in the Figures, the detent recess 102 is near the key receiving portion 98 of the central opening 94.

Two electrical contact elements 104 and 106 are fixed on the lower end surface 90 of the rotor member 86. The contact elements 104, 106 are made of electrically conductive material such as copper. The contact elements 104, 106 are spaced apart from the axis 32. The radial distance between the axis 32 and the contact elements 104, 106 is the same as the radial distance between the axis 32 and the terminal grid 62 (FIG. 2) on the contact wall 54.

The contact elements 104, 106 (FIG. 5) are diametrically opposite each other with the contact element 104 being near the detent recess 102 and the contact element 106 being near the detent recess 100. An electrical connection 108 (shown in phantom in FIG. 5) extends between the contact elements 104 and 106.

A detent plunger 112 (FIG. 1) of the rotary assembly 84 is located in the detent recess 100. The detent plunger 112 is movable relative to the rotor member 86 along the detent recess 100 to enable a portion of the detent plunger to extend into the central opening 94 of the rotor member 86. A compression spring 114 (schematically shown) is located within the detent recess 100, between the radially outer end of the detent recess and the detent plunger 112 (to the right of the detent plunger as viewed in FIG. 1). The spring 114 biases the detent plunger 112 outward from the detent recess 100 and into the central opening 94 in the rotor member 86.

Another detent plunger 116 of the rotary assembly 84 is located in the other detent recess 102. The detent plunger 116 is movable relative to the rotor member 86 along the detent recess 102 to enable a portion of the detent plunger to extend out (upward as viewed in FIG. 1) of the upper surface 88 of the rotor member 86. A compression spring 118 (schematically shown) is located within the detent recess 102, between the axially inner end of the detent recess and the detent plunger 116 (below the detent plunger as viewed in FIG. 1). The spring 118 biases the detent plunger 116 outward from the detent recess 102.

The rotary assembly 84 is located within the first chamber 56 of the housing 46. The rotary assembly 84 is rotatable about the axis 32 relative to the housing 46. The stem 34 of the control member 28 extends through the cylindrical portion 96 of the central opening 94 in the rotor member 86. The key projection 38 on the stem 34 is located within the key receiving portion 98 of the central opening 94. The rotary assembly 84 is fixed for rotation about the axis 32 with the control member 28 because the key projection 38 is interfit into the key receiving portion 98 of the central opening 94 in the rotor member 86. A pair of spacers 120, 122 prevent axial movement of the rotor member 86 of rotary assembly 84 relative to the housing 46.

Figure 4:
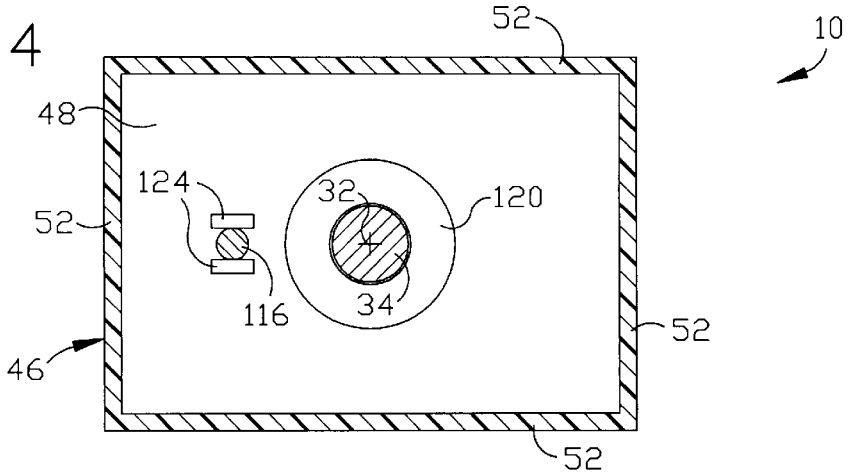
FIG. 4 is a view taken along line 4—4 in FIG. 1.

The detent plunger 116 (FIG. 1) is biased into engagement with the first wall 48 of the housing 46 by the spring 118. In the initial position of the apparatus 10 (FIG. 1), the detent plunger 116 is located between two detent ridges 124 (FIG. 4) on the first wall 48. The detent ridges 124 extend (downward as shown in FIG. 1, only one detent ridge shown in FIG. 1) from the first wall 48 into the first chamber 56. In the initial position of the apparatus 10 (FIG. 1), the detent ridges 124 hold the detent plunger 116 and thus block rotation of the rotary assembly 84 about the axis 32.

When the rotary assembly is thus positioned within the chamber 56, the contact element 104 (FIG. 2) engages the half of the terminal grid 62 which contains the resistor 65 and the insulator segment 66. The contact element 106 engages the conductor 64 on the other half of the terminal grid 62. During rotation of the rotary assembly 84 as described below, the contact element 104 on the rotor member 86 is movable in an arc about the axis 32 along its half of the terminal grid 62 and the contact element 106 is movable in an arc along its half of the terminal grid. The rotary assembly 84 can rotate until the contact elements 104, 106 abut the stops 63. In an initial position of the apparatus 10 (shown in FIG. 1), the contact element 104 (FIG. 2) engages the insulator segment 66 and the contact element 106 engages the portion of the conductor 64 diametrically opposite to the insulator segment 66.

The control member 28 is movable along the axis 32 relative to the rotary assembly 84. In the initial position of the apparatus 10 (FIG. 1), the key projection 38 is located approximately midway along the axial extend of the key receiving portion 98. During axial movement of the control member 28, the key projection 38 moves parallel to the axis 32 along the key receiving portion 98 of the central opening 94. In the initial position of the apparatus 10 (FIG. 1), the detent plunger 112 is biased to extend into the first notch 40 on the stem 34 and blocks axial movement of the control member 28.

Figure 6:
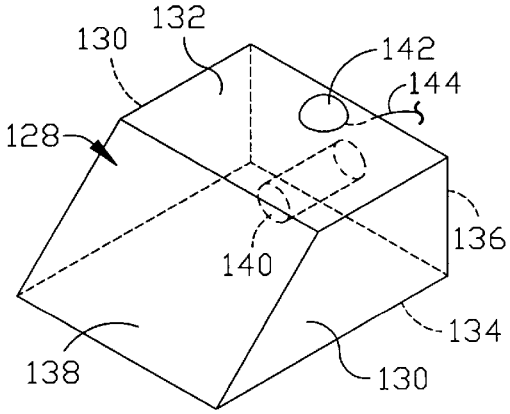
FIG. 6 is an illustration of another part of the apparatus of FIG. 1.

The apparatus 10 includes a plastic slider member 128. The slider member 128 (FIG. 6) has two trapezoidal side surfaces 130 which are parallel to each other. Rectangular top and bottom surfaces 132 and 134 of the slider member 128 perpendicularly intersect the side surfaces 130. Rectangular back and bearing surfaces 136 and 138 of the slider member 128 perpendicularly intersect the side surfaces 130. The bearing surface 138 extends along the inclined edges of the side surfaces 130 and faces generally upward, as viewed in the Figures.

A recess 140 extends into the slider member 128 from the back surface 136, but does not extend completely through the slider member. An electrical contact element 142 is fixed on the top surface 132 of the slider member 128. The contact element 142 is made of an electrically conductive material, such as copper. An electrical lead 144 extends from the contact element 142 and away from the slider member 128.

The slider member 128 (FIG. 1) is located within the second chamber 58 of the housing 46 and is located toward one side of the axis 32 (right side as viewed in FIG. 1). The bottom surface 134 of the slider member 128 engages the second wall 50 of the housing 46. The back surface 136 of the slider member 128 faces one of the side walls 52 of the housing 46 and the side surfaces 130 of the slider member engage the two side walls 52 adjacent to the first side wall 52 of the housing. The bearing surface 138 faces the tip 36 of the stem 34 of the control member 28. The electrical lead 144 extends from the slider member 128 and out from the housing 46. A compression spring 146 (schematically shown) extends from the recess 140 and is in engagement with the one side wall 52 adjacent to the back surface 136 of the slider member 128.

The slider member 128 is movable relative to the housing 46, but is constrained to move only in linear directions toward and away from the axis because of the engagement of the side surfaces 130 of the slider member 128 with the side walls 52 of the housing. The directions of movement of the slider member 128 are transverse to the axis 32. Specifically, the directions of movement are perpendicular or orthogonal to the axis 32. The spring 146 biases the slider member 128 away from the adjacent side wall 52 and toward the tip 36 of the stem 34 (in a direction toward the left as viewed in FIG. 1) so that the bearing surface 138 is pressed into engagement with the tip 36.

In the initial position of the apparatus 10 (FIG. 1), the tip 36 of the stem 34 is in engagement with a lower half of the bearing surface 138 of the slider member 128. The slider member 128 is held by the tip 36 against the bias of the spring 146 in a position relatively near to the adjacent side wall 52 of the housing 46. Also in the initial position of the apparatus 10 (FIG. 1), the contact element 142 engages the contact wall 54 but is located away from the conductor 70 on the contact wall.

Portions of the apparatus 10 are part of two electrical circuits. In one electrical circuit (FIG. 7, schematic representation), the one lead 20 of the power source 12 is connected to the lead 22 of the first lamp 14. The other lead 21 of the power source 12 is connected to the lead 72 extending from the conductor 70 on the contact wall 54 in the housing 46. The lead 23 of the first lamp 14 is connected to the lead 144 extending from the contact element 142 on the slider member 128.

Figure 8:
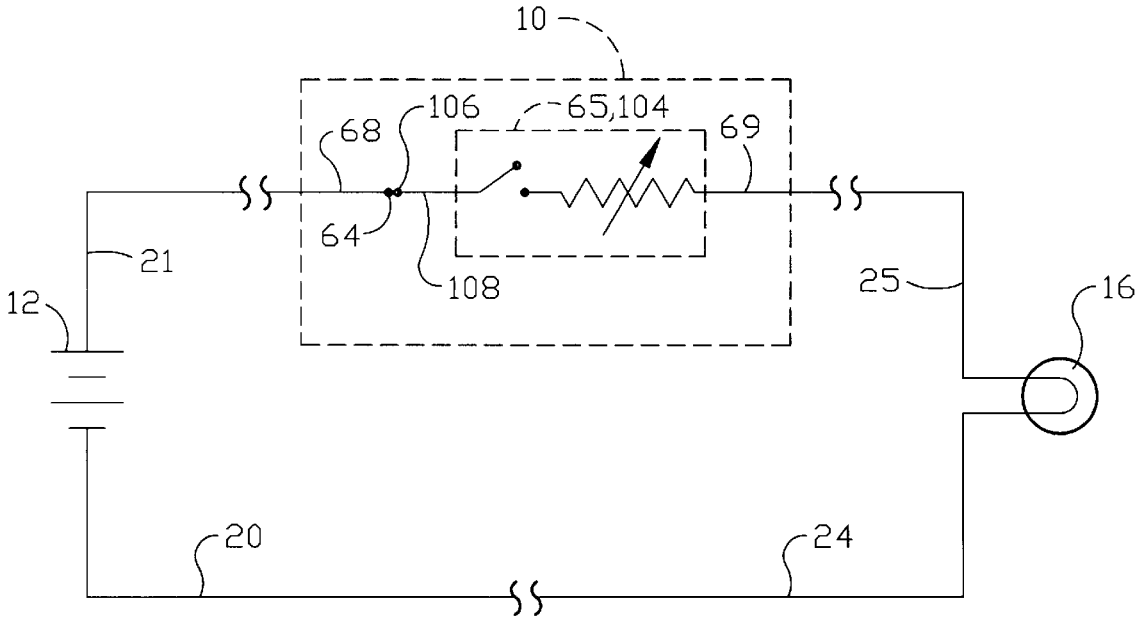
FIG. 8 is a schematic illustration of another electrical circuit containing parts of the apparatus of FIG. 1.

In another electrical circuit (FIG. 8, schematic representation), the one lead 20 of the power source 12 is connected to the lead 24 of the second lamp 16. The other lead 21 of the power source 12 is connected to the lead 68 extending from the conductor 64 in the terminal grid 62 on the contact wall 54 in the housing 46. The lead 25 of the second lamp 16 is connected to the lead 69 extending from the resistor 65 in the terminal grid 62 on the contact wall 54 in the housing 46.

Referring now to FIG. 1, in the initial position of the apparatus 10 the electrical energy from the power source 12 is not delivered to the first and second lamps 14 and 16. The contact element 142 (FIG. 3) on the slider member 128 is not in engagement with the conductor 70 on the contact wall 54 and current does not flow between the conductor 70 (FIG. 7) and the contact element 142. Thus, the electrical circuit containing the power source 12 and the first lamp 14 is not complete and the first lamp is not energized. The contact element 104 (FIG. 2) on the rotor member 86 is in engagement with the insulator segment 66 on the terminal grid 62. Current from the power source 12 does not flow through the resistor 65 (FIG. 8) of the terminal grid 62 because the contact element 104 (FIG. 2) rests on the insulator segment 66. Thus, the electrical circuit (FIG. 8) containing the power source 12 and the second lamp 16 is not complete and the second lamp is not energized.

The first lamp 14 is controlled via a push-pull operation mode of the apparatus 10. When it is desired to energize the first lamp 14, the operator manually grasps the knob 30 and pulls the control member 28 along the axis 32 (upwards as shown in FIG. 1) from the initial position. A pulling force is transmitted to the stem 34. The surface of the stem 34 at the first notch 40 bears on the detent plunger 112 and pushes the detent plunger 112 into the detent recess 100 against the bias of the spring 114. As the detent plunger 112 moves into the detent recess 100, the control member 28 continues to move (upward) along the axis 32. The rotary assembly 84 may bear on the spacer 120 but does not move axially relative to the housing 46. Movement of the control member 28 along the axis 32 is relative to the housing 46 and the rotary assembly 84.

Figure 9:
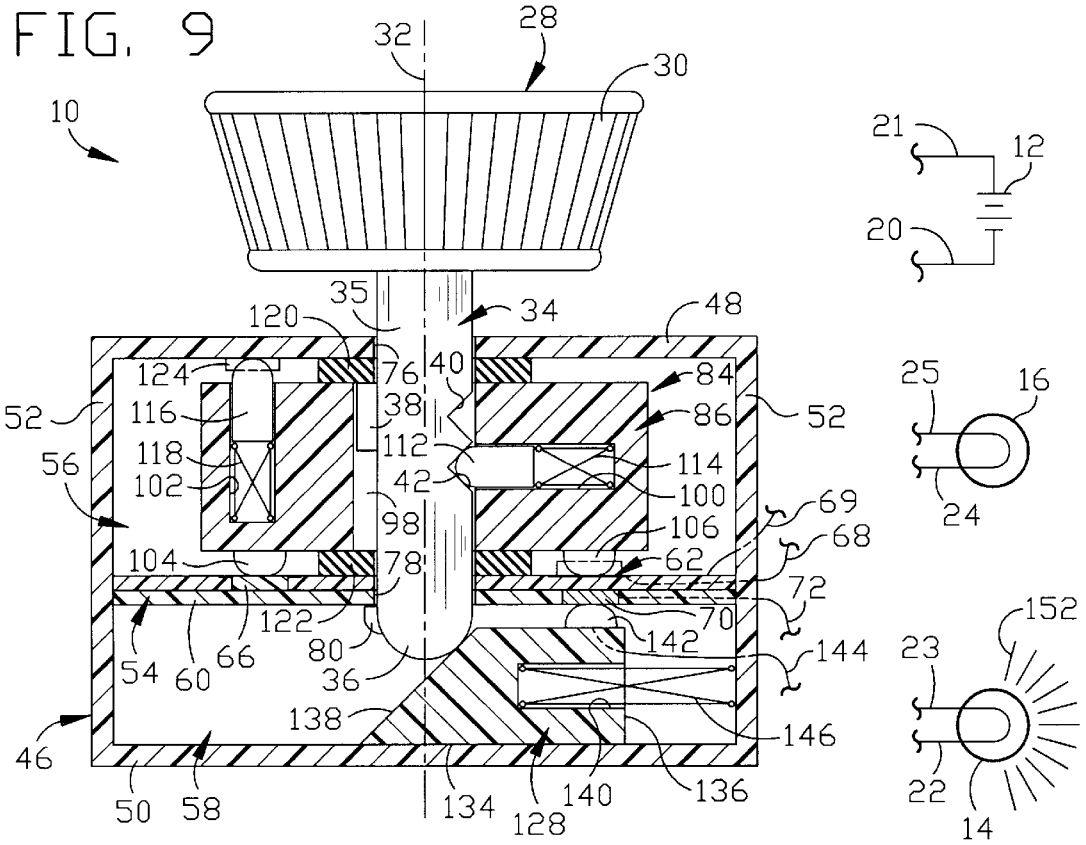
FIG. 9 is a view similar to FIG. 1, but with certain parts in a different position.

When the detent plunger 112 is sufficiently displaced into the detent recess 100, the segment of the stem 34 which separates the first and second notches 40 and 42 moves past the detent plunger. The detent plunger 112 snaps out of the detent recess 100 and into the second notch 42 under the bias of the spring 114. The control member 28 is in an actuated position as shown in FIG. 9. When the control member 28 is in the actuated position, the control member is prevented from further upward movement along the axis 32 by the retainer projection 80. The control member 28 is held in the actuated position, under the bias of the spring 114, by the engagement of the detent plunger 112 in the second notch 42.

As the control member 28 moves from the initial position (FIG. 1) to the actuated position (FIG. 9), the slider member 128 moves linearly under the bias of the spring 146. Specifically, the spring 146 moves the slider member 128 in a direction away from the adjacent side wall 52 and toward the axis 32 (toward the left in the Figures). As the tip 36 of the control member 28 moves upward, the bearing surface 138 slides relatively under the tip and the tip progresses relatively up the bearing surface 138. In the actuated position shown in FIG. 9, the tip 36 is in engagement with the upper half of the bearing surface 138. When the control member 28 reaches the actuated position shown in FIG. 9, the slider member 128 is held against further movement (toward the left) by the tip 36.

As the slider member 128 moves from the initial position (FIG. 1) to the actuated position (FIG. 9), the contact element 142 on the slider member moves out of engagement with the electrically insulating material of the layer 60 and into engagement with the conductor 70 to complete the circuit (FIG. 7) which includes the power source 12 and the first lamp 14. The first lamp 14 is energized (FIG. 9) and light energy 152 radiates from the first lamp. The conductor 70 on the contact wall 54 and the contact element 142 on the slider member 128 thus act as a switch controlling the flow of electrical current between the power source 12 and the first lamp 14.

Figure 7:
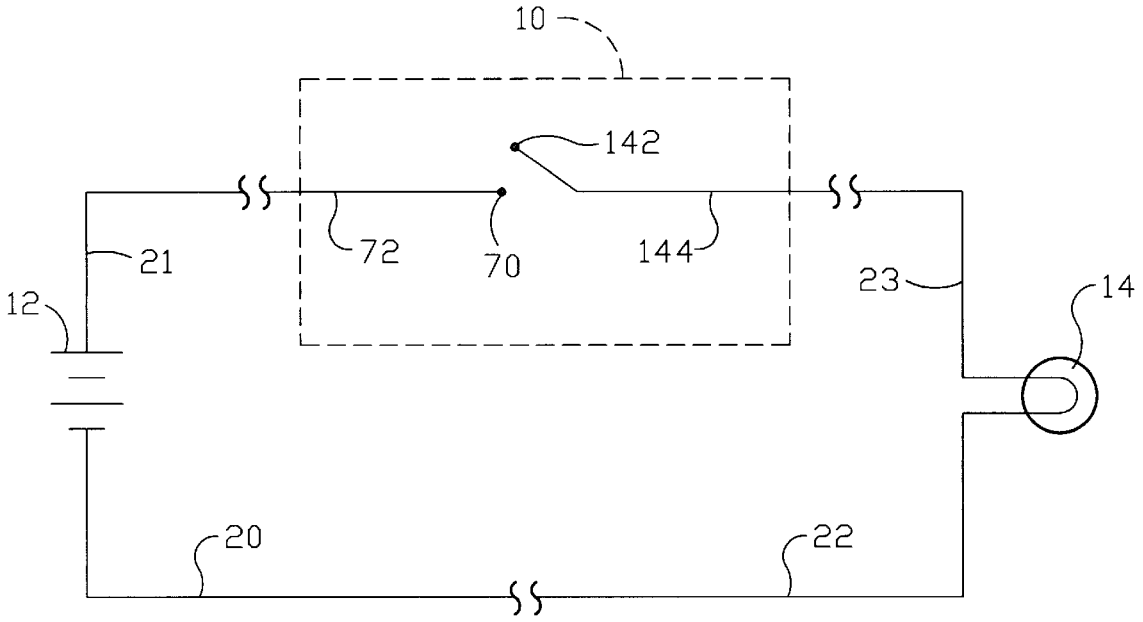
FIG. 7 is a schematic illustration of an electrical circuit containing parts of the apparatus of FIG. 1.

In order to de-energize the first lamp 14, the operator pushes on the knob 30 along the axis 32 in a direction toward the housing 46 (downward as shown in FIG. 7). The stem 34 pushes the detent plunger 112 into the detent recess 100 until the segment of the stem 34 separating the first and second notches 40 and 42 passes the detent plunger 112. The detent plunger 112 snaps into the first notch 40 (FIG. 1) under the bias of the spring 114. Simultaneously, the tip 36 of the stem 34 bears against the bearing surface 138 and pushes the slider member 128 in the linear direction toward the adjacent side wall 52 against the bias of the spring 146. Specifically, the tip 36 moves relatively down along the bearing surface 138 and the tip pushes the bearing surface relatively out from under the tip. The contact element 142 on the slider member 128 moves out of engagement with the conductor 70 and moves into engagement with the electrically insulating material of the layer 60. Accordingly, the flow of current between the power source 12 and the first lamp 14 is interrupted.

During movement of the control member 28 along the axis 32 to control the first lamp 14, the key projection 38 on the stem 34 moves along the key receiving portion 98 of the central opening 94. The rotor member 86 remains stationary. Accordingly, axial movement of the control member 28, as described above, regardless of the rotational position of the rotor member 86, does not effect operation of the second lamp 16 because the contact elements 104, 106 do not move relative to the terminal grid 62.

The second lamp 16 is controlled via a rotary operation mode of the apparatus 10. In order to energize the second lamp 16, the operator manually grasps the knob 30 of the control member 28 and rotates the knob about the axis 32 from the initial position (FIG. 1). A rotational force is transmitted from the key projection 38 to the rotor member 86 at the key receiving portion 98 of the central opening 94. The rotor member 86 rotates with the control member 28 about the axis 32. As the rotor member 86 rotates, the detent plunger 116 bears against the detent ridge 124. The detent ridge 124 presses the detent plunger 116 into the detent recess 102 (downward as shown in FIG. 1) against the bias of the spring 118. Once the detent plunger 116 is sufficiently depressed, the detent plunger moves past the detent ridge 124. Once the detent plunger 116 is past the detent ridge 124, the detent plunger snaps (upward) back into engagement with the first wall 48 under the bias of the spring 118. As a result of the detent plunger 116 moving out from between the detent ridges 124, the control member 28 is readily rotatable about the axis 32.

Figure 10:
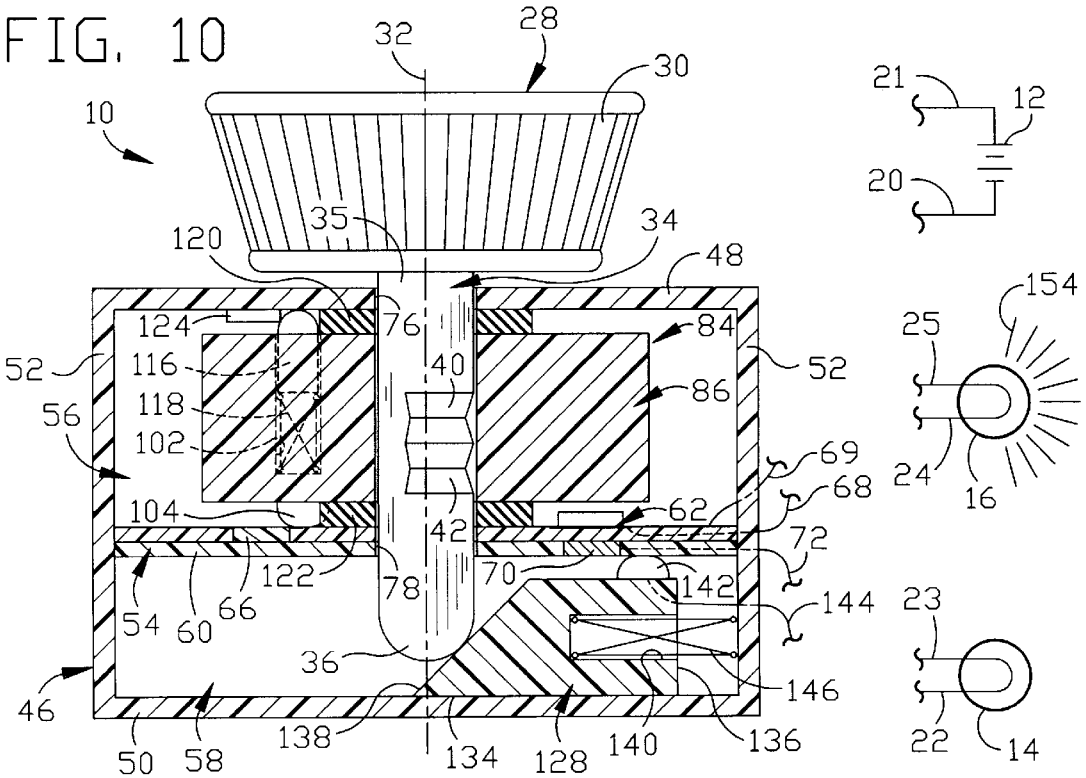
FIG. 10 is a view similar to FIG. 1, but with certain parts in a different position.

The contact elements 104, 106 move about the axis 32 in circular paths along the terminal grid 62 as part of the rotary assembly 84. The contact element 104 (FIG. 10) moves out of engagement with the insulator segment 66 and into engagement with the resistor 65 of the terminal grid 62. The contact element 106 moves across the conductor 64 while maintaining engagement with the conductor. The circuit (FIG. 8) which includes the power source 12, the terminal grid 62, the contact elements 104 and 106, and the second lamp 16 is complete. The second lamp 16 is energized (FIG. 10) and light energy 154 radiates from the second lamp. The contact element 104 (FIG. 2) and the resistor 65 thus act as a switch controlling the flow current between the power source 12 and the second lamp 16.

The amount of current flowing to the second lamp 16, and thus the intensity of light energy 154 from the second lamp, is dependent upon the location of the contact element 104 on the resistor 65 of the terminal grid 62. Specifically, the amount of electrical resistance provided by the resistor 65 is dependent upon the location of the contact element 104 on the resistor 65 of the terminal grid 62. Thus, the rotary assembly 84 provides a dimmer function for the second lamp 16.

In order to de-energize the second lamp 16, the operator grasps the knob 30 of the control member 28 and rotates the control member back toward the initial position (FIG. 1). The contact element 106 is moved back across the conductor 64 and the contact element 104 is moved back toward the insulator segment 66. When the rotary assembly 84 reaches the initial position (FIG. 1), the detent plunger 116 snaps back into engagement with the first wall 48 between the detent ridges 124. At the same time, the contact element 104 moves into engagement with the insulator segment 66. The flow of electric current between the power source 12 and the second lamp 16 is interrupted and the second lamp is de-energized.

During rotation of the control member 28 about the axis 32 to control the brightness of the second lamp 16, the tip 36 of the control member 28 remains in contact with the bearing surface 138 of the slider member 128. The hemispherical shape of the tip 36 permits the tip to rotate about the axis 32 relative to the bearing surface 138 while the slider member 128 remains stationary. Accordingly, rotation of the control member 28 does not effect operation of the first lamp 14 because the contact element 142 on the slider member 128 remains stationary relative to the conductor 70 on the contact wall 54.

From the above description of the invention, those skilled in the art will perceive improvements, changes and modifications. For example, the control member 28 may be movable into more than two positions along the axis 32. The slider member 128 would, accordingly, have a similar number of positions as the slider member moves transverse to the axis 32, and more than one contact on the lower surface of the contact wall 54 would be provided. Alternatively, a variable resistor, similar to the resistor 65, could be provided on the lower surface of the contact wall, to provide a variable amount of current to the first lamp 14 during movement of the slider member 128. The terminal grid 62 on the upper surface of the contact wall 54 could be replaced with a single electrical contact, changing the energization of the second lamp 16 from variable electrical energization function to an on-off energization function. Such improvements, changes and modifications within the skill of the art are intended to be covered by the appended claims.

Having described the invention, I claim the following:

1. An apparatus for controlling electrical energy, said apparatus comprising:

a manually operated control member having a knob portion for manual engagement and a stem portion extending along an axis;

panel means having an opening for receiving said stem portion, said control member being manually rotatable about the axis relative to said panel means and being manually movable along the axis relative to said panel means;

means for electrically connecting a first circuit in response to rotation of said control member including a rotor member, said rotor member extending about said stem portion and being rotatable about the axis relative to said panel means, said control member being movable relative to said rotor member along the axis;

means for connecting said rotor member and said stem portion to rotate said rotor member during rotation of said control member;

means for electrically connecting a second circuit in response to movement of said control member along the axis from a first position to a second position relative to said rotor member and said panel means; and means for biasing said control member into said first and second positions including detent means located between said rotor member and said stem portion.

2. An apparatus as set forth in claim 1, wherein said stem portion of said control member has a location with two notches, said detent means includes a detent plunger movably supported by said rotor member and biased into engagement with said stem portion at the location of said notches.

3. An apparatus as set forth in claim 1, wherein said means for connecting said rotor member and said stem portion includes interfitting portions of said rotor member and said stem portion.

4. An apparatus as set forth in claim 3, wherein said interfitting portions of said rotor member and said stem portion include a projection extending radially from said stem portion and a portion of said rotor member which defines a portion of an opening that extends along the axis through said rotor member, said projection being located within said portion of said opening and being movable parallel to the axis along said portion of said opening.

5. An apparatus as set forth in claim 1, wherein said means for electrically connecting a second circuit includes a member movable transverse to the axis during movement of said control member along the axis.

6. An apparatus as set forth in claim 5, wherein said member movable transverse to the axis is a slider member which engages a segment of said stem portion, said segment of said stem portion rotates on a surface of said slider member without movement of said slider member during rotation of said control member, said surface of said slider member slides against said segment of said stem portion as said slider member moves during movement of said control member along the axis.

7. An apparatus as set forth in claim 5, wherein said segment of said stem portion is a tip of said stem portion, said tip is hemispherical.

8. An apparatus for controlling electrical energy, said apparatus comprising:

a control member having a knob portion for manual engagement and a stem portion extending along an axis;

panel means having an opening for receiving said stem portion, said control member being manually rotatable about the axis relative to said panel means and being manually movable along the axis relative to said panel means;

means for electrically connecting a first circuit in response to rotation of said control member; and means for electrically connecting a second circuit in response to movement of said control member along the axis;

said means for electrically connecting said second circuit including a member constrained to move in a direction orthogonal to the axis during movement of said control member along the axis;

said member constrained to move in a direction orthogonal to the axis being a slider member;

said stem portion and said slider member having surfaces in engagement;

said surface of said stem portion moving relative to said surface of said slider member without movement of said slider member during rotational movement of said control member;

said surface of said slider member sliding against said surface of said stem portion as said slider member moves during movement of said control member along the axis.

9. An apparatus as set forth in claim 8, including a spring for biasing said slider member into engagement with said stem portion.

10. An apparatus as set forth in claim 8, wherein said means for electrically connecting a second circuit includes an electrical contact element on said slider member.

11. An apparatus as set forth in claim 8, wherein said means for electrically connecting a first circuit includes a rotor member extending about said stem portion and rotatable about the axis relative to said panel means.

12. An apparatus as set forth in claim 11, including means for connecting said rotor member and said stem portion to rotate said rotor member during rotation of said control member.

13. An apparatus as set forth in claim 12, wherein said means for connecting said rotor member and said stem portion includes a key projection extending from the stem portion which moves said rotor member during rotation of said control member and which moves relative to said rotor member during axial movement of said control member.

14. An apparatus as set forth in claim 12, wherein said means for electrically connecting a first circuit includes an electrical contact element on said rotor member.

15. An apparatus as set forth in claim 11, wherein said control member moves from a first position to a second position along the axis to connect the second circuit.

16. An apparatus for controlling electrical energy, said apparatus comprising:

a control member having a knob portion for manual engagement and a stem portion extending along an axis;

panel means having an opening for receiving said stem portion, said control member being manually rotatable about the axis relative to said panel means and being manually movable along the axis relative to said panel means;

means for electrically connecting a first circuit in response to rotation of said control member;

said means for electrically connecting a first circuit including a rotor member extending about said stem portion and rotatable about the axis relative to said panel means;

means for electrically connecting a second circuit in response to movement of said control member along the axis;

said means for electrically connecting said second circuit including a member constrained to move in a direction orthogonal to the axis during movement of said control member along the axis;

said control member moving from a first position to a second position along the axis to connect the second circuit; and means for biasing said control member into said first and second positions;

said means for biasing including detent means located between said rotor member and said stem portion.

17. An apparatus as set forth in claim 16, wherein said stem portion has two notches, said detent means includes a detent plunger engageable with said notches.

18. An apparatus for controlling electrical energy, said apparatus comprising:

a control member having a knob portion for manual engagement and a stem portion extending along an axis from said knob portion to a tip segment;

panel means having an opening for receiving said stem portion, said control member being manually rotatable about the axis relative to said panel means and being manually movable along the axis relative to said panel means;

means for electrically connecting a first circuit in response to rotation of said control member including a rotor member, said rotor member being rotatable about the axis relative to said panel means, said control member being movable relative to said rotor member along the axis;

means for connecting said rotor member and said stem portion to rotate said rotor member during rotation of said control member;

means for electrically connecting a second circuit in response to movement of said control member along the axis relative to said rotor member and said panel means including a slider member, said slider member having a surface engaging said tip segment of said stem portion, said slider member being movable relative to said control member in a direction transverse to the axis as said surface of said slider member slides against said stem portion during movement of said control member along the axis; and a spring for biasing said slider member against said tip segment of said stem portion.

19. An apparatus for controlling electrical energy, said apparatus comprising:

a control member having a knob portion for manual engagement and a stem portion extending along an axis from said knob portion to a tip segment;

panel means having an opening for receiving said stem portion, said control member being manually rotatable about the axis relative to said panel means and being manually movable along the axis relative to said panel means;

means for electrically connecting a first circuit in response to rotation of said control member including a rotor member, said rotor member being rotatable about the axis relative to said panel means, said control member being movable relative to said rotor member along the axis;

means for connecting said rotor member and said stem portion to rotate said rotor member during rotation of said control member;

means for electrically connecting a second circuit in response to movement of said control member along the axis relative to said rotor member and said panel means including a slider member, said slider member having a surface engaging said tip segment of said stem portion, said slider member being movable relative to said control member in a direction transverse to the axis as said surface of said slider member slides against said stem portion during movement of said control member along the axis; and means for biasing said control member into first and second positions along the axis.

20. An apparatus as set forth in claim 19, wherein said means for biasing includes a detent means located between said rotor member and said stem portion.

* * * * *